United States Patent [19]

Tong

[11] 4,223,248

[45] Sep. 16, 1980

[54] FUSED LIGHT STRING SET

[76] Inventor: George K. K. Tong, 39 MacDonnell Rd., Hong Kong, Hong Kong

[21] Appl. No.: 939,974

[22] Filed: Sep. 6, 1978

[51] Int. Cl.[2] ..... H05B 37/03

[52] U.S. Cl. ..... 315/185 S; 315/210

[58] Field of Search ..... 315/66, 185 R, 185 S, 315/210, 122; 337/262, 263, 255, 256

[56] References Cited

U.S. PATENT DOCUMENTS

| | | | |
|---|---|---|---|
| 1,455,566 | 5/1923 | Briggs | 337/256 |
| 1,974,472 | 9/1934 | Seghers | 315/185 S |
| 3,873,880 | 3/1975 | Riddell | 315/185 S |
| 3,968,398 | 7/1976 | Lehmann et al. | 315/185 S |
| 4,030,059 | 6/1977 | Tong | 337/262 |

*Primary Examiner*—David K. Moore

*Attorney, Agent, or Firm*—Kalish & Gilster

[57] ABSTRACT

A fused miniature light string set having a plurality of sockets receiving incandescent lamps, a plug at one end of string supplying power to the lamps and a receptacle at the other end for connecting another light string set to permit tandem stringing of sets. At least some of the sockets are adapted to receive shunt-type incandescent lamps having a shunt across the filament for permitting continued current flow if the filament burns out. All of the sockets are electrically connected in a series circuit by relatively fine gauge wire, other conductors being of a larger gauge. One end socket of this series has a terminal connected by one of the larger gauge wires to a plug terminal and by another such wire to a receptacle terminal. The other end socket similarly has one such wire connected to the other plug terminal and another such wire to the other receptacle terminal. The set is fused, there being a fuse associated with each end socket, either an in-line fuse holder or by fuse lamps in the end sockets, which are configured differently from the other sockets. The lamps are mounted in lamp holders of two different configurations, one receivable only by the end sockets and the other receivable only by the remaining sockets.

19 Claims, 16 Drawing Figures

FIG. 3A
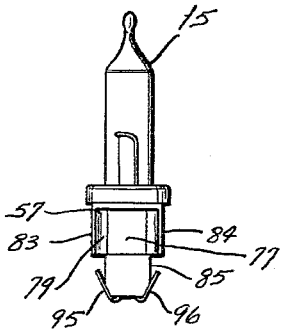
FIG. 4A
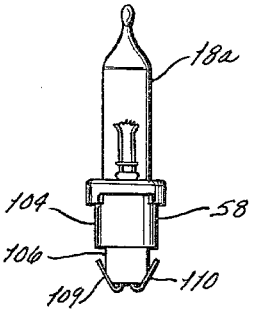
FIG. 5A
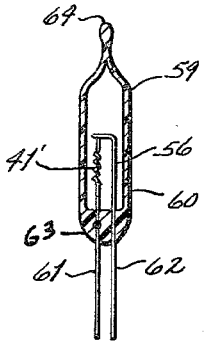
FIG. 3B
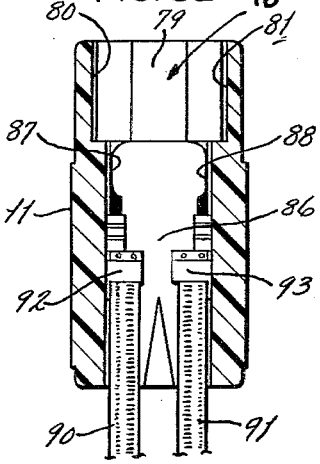
FIG. 4B
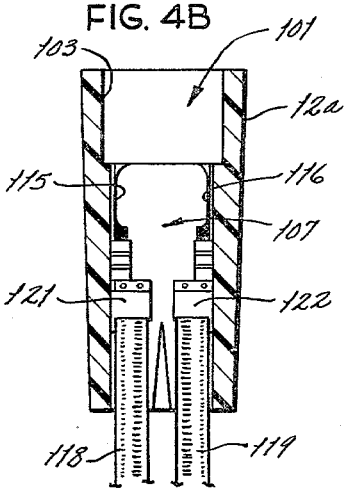
FIG. 5B
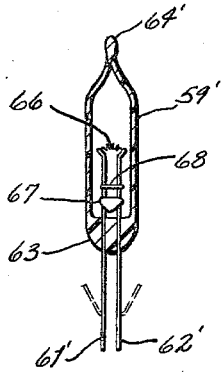
FIG. 6
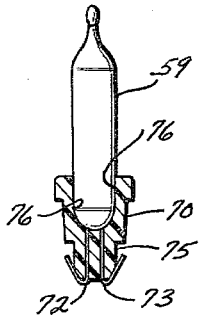
FIG. 3C
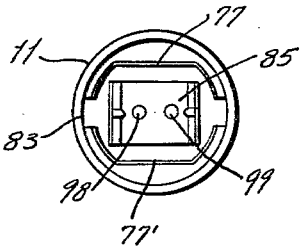
FIG. 4C
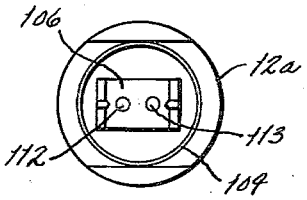
FIG. 8
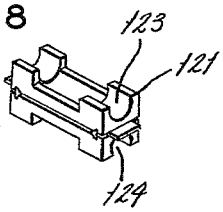
FIG. 9
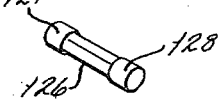
FIG. 7
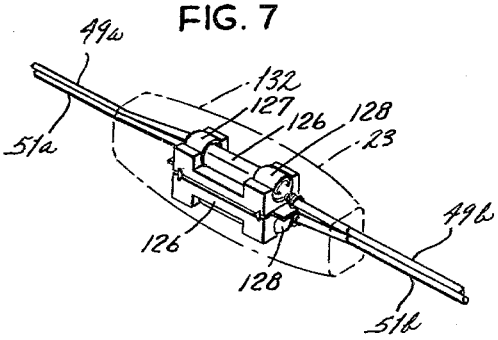
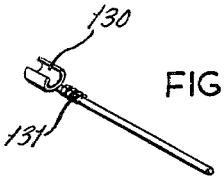
FIG. 10

FUSED LIGHT STRING SET

BACKGROUND AND SUMMARY OF THE DISCLOSURE

The present invention relates to light string sets of the type having incandescent lamps and, more particularly, to a miniaturized light string set employing series-connected shunt-type incandescent lamps and a fusing arrangement.

The present invention is an improvement of the fused decorative string set described and claimed in Lehmann et al. U.S. Pat. No. 3,968,398 issued July 6, 1976.

Said Lehmann et al. patent disclosed a series-connected decorative incandescent lamp string set permitting the use of fine gauge wire in a series lamp circuit. Lamps at the end of the series string which were of an unshunted type whereas the remaining lamps in the series string were of a shunted type permitting continued current flow to the lamp in the event of filament burnout. The unshunted lamps at each end of the string were intended to serve as a fuse for the entire set, since the fine gauge wire (e.g., 24-gauge) interconnecting the shunted incandescent lamps was of insufficient size to be adequately protected by normal utility fuses in conventional 15- and 24-ampere branch circuits which, in normal practice, supply AC power to such string sets and other AC appliances connected at normal AC receptacles.

A problem attendant to the use of the string set disclosed and claimed in said Lehmann et al. patent is that tandem stringing of light sets was precluded. If a Christmas tree or the like was desired to be strung with multiple string sets, all of the plugs of each of the string sets had to be connected at approximately the same location to a source of power. Use of such arrangement is extremely awkward, at best, for the stringing of a large tree with lights since it is desirable if several strings are to be used that each successive string be connected in tandem to the end of the preceding string, i.e. so as to provide continuous end-to-end stringing.

Another difficulty inherent in the Lehmann et al. construction was that the plural use of light string sets, all connected at the same location, to an AC utility service provided no protection against the possibility that plural stringing of lights might cause excessive use of current such as to constitute a heavy electrical load.

Accordingly, among the several objects of the present invention may be noted the provision of an improved light string set; the provision of such a light string set utilizing miniature incandescent lamps; the provision of such a light string set permitting tandem stringing of lights interconnecting individual light sets of the character described in end-to-end relationship; the provision of such a light string set permitting the optimal use of fuse lamps to provide short circuit protection of a series string of incandescent lamps, a related object being the provision of such a light string set permitting the use of series interconnection of a plurality of miniature incandescent lamps by relatively fine gauge wire. A related object is the provision of such a light string set permitting tandem stringing of successive light string sets even though fine gauge wire is utilized to provide a series circuit interconnection of incandescent lamps of each such string.

Another object of the invention is the provision of a light string set which is fused to provide protection against a short-circuit or excessive current flow into the set, a related object being the provision of such a fused set which is of a universal configuration amenable to alternative fusing embodiments as desired in ultimate configuration so as to facilitate manufacturing.

Other objects of the invention include the provision of a light string set utilizing miniature lamps which are easily changed in the event of lamp burnout; the provision of such a light string set which is extremely attractive and pleasing to the eye, producing a sparkling optical effect from each lamp; and the provision of such light set which is conducive to extremely economical manufacture through the use of low cost materials and simplicity of construction.

Other objects will be in part apparent and in part pointed out in the following description.

BRIEF DESCRIPTION OF THE DRAWINGS

FIG. 3A is a side elevational view of an incandescent fuse lamp of a miniature nature used in the invention.

FIG. 3B is a cross-section of a lamp socket for receiving the incandescent lamp of 3A.

FIG. 3C is a bottom elevational view of a lamp holder receivable in the socket of FIG. 3B.

FIG. 4A is a side elevational view of a miniaturized incandescent lamp which is used in the light string set of FIG. 1 with fuse lamps of the configuration shown in FIG. 3A.

FIG. 4B is a cross-section view of a lamp socket for receiving the incandescent lamp of FIG. 4A.

FIG. 4C is a bottom elevational view of a lamp holder receivable in the socket of FIG. 4B.

FIGS. 5A and 5B are cross-sections respectively, of an incandescent fuse lamp bulb and shunted lamp bulb for use in the lamp assembly of FIG. 3A and FIG. 4A.

FIG. 6 is a view in cross-section illustrating a lamp of FIG. 5 as mounted in a lamp holder to provide an assembly as illustrated in FIG. 3A or FIG. 4A.

FIG. 7 is a perspective view of a fuse holder of the light set of FIG. 1, a molded enclosure for the fuse holder being depicted by phantom lines.

FIG. 8 is another perspective view of the fuse block but without fuses therein.

FIG. 9 is a cartridge fuse of the type mounted in the fuse block of FIG. 8.

FIG. 10 is a perspective view of a terminal assembly for making electrical contact with such fuse in the fuse holder of FIG. 7.

Corresponding reference characters indicate corresponding parts throughout the several views of the drawings.

DESCRIPTION OF THE PREFERRED EMBODIMENTS

Figure 1:
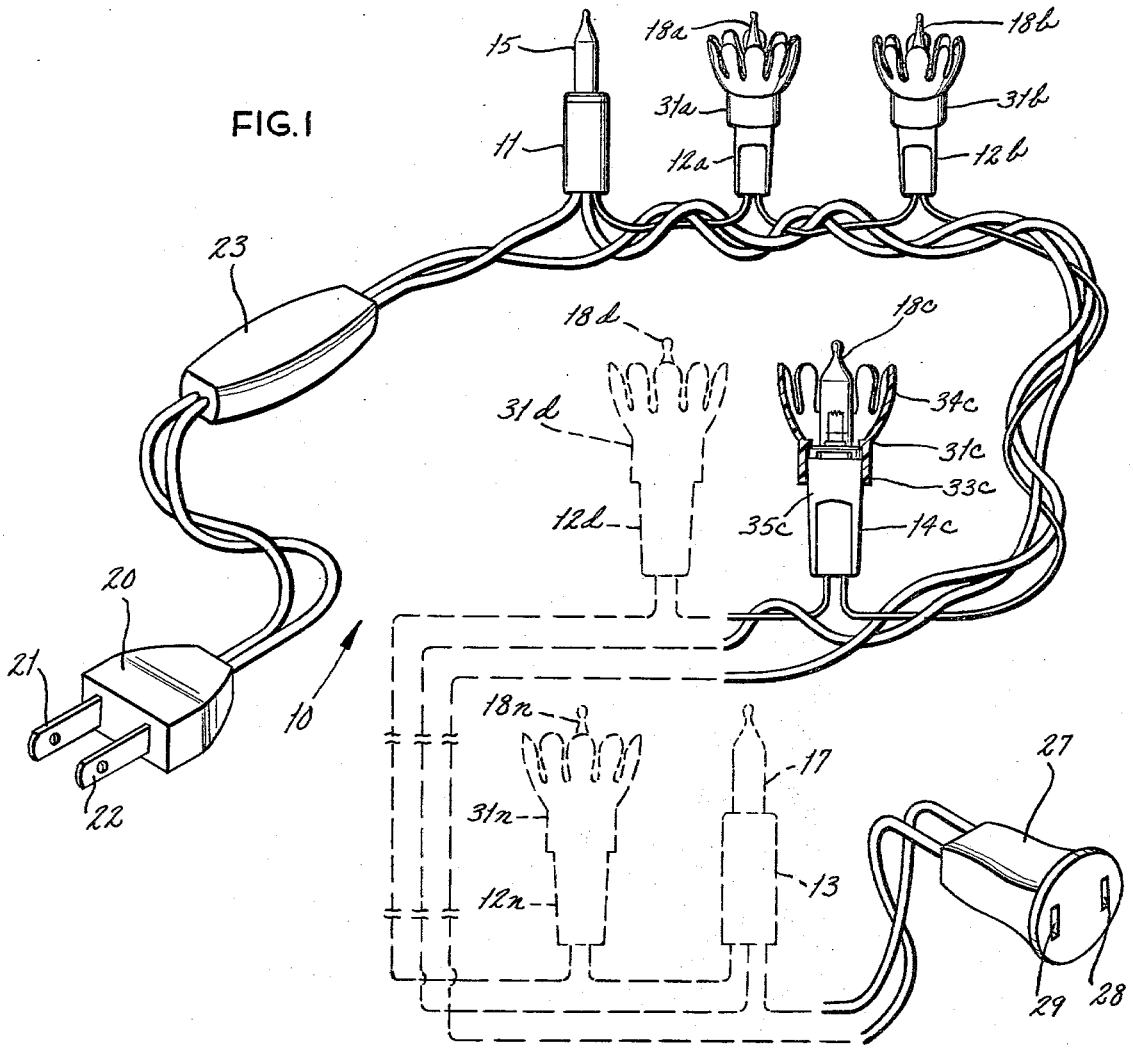
FIG. 1 is a pictorial representation of a first embodiment of light string set in accordance with the invention, illustrating the form of certain lamp socket and lamp reflector features with the reflector shown in cross-section, and illustrating other portions thereof in the form of an electrical circuit diagram.

Referring now to FIG. 1, a first embodiment of a new light string set of the present invention is indicated in its entirely at 10. String set 10 comprises a plurality of lamp sockets 11, 12*a*–12*n*, and 13, there being a convenient number of lamp sockets such as fifty so that the total length of the cord may be several tens of feet in length. As will be explained, lamp sockets 11 and 13 are different from lamp sockets 12*a*–12*n*. More specifically, lamp sockets 11 and 13 are specifically adapted to receive only a special lamp holder. The lamp holder may contain a fuse-type incandescent lamp or a shunt-type incandescent lamp, in accordance with a desired embodiment. For purposes of illustration only, lamp socket 11 is shown as having a fuse lamp 15 therein and lamp socket 13 is shown as having a fuse lamp 17 therein.

Each of the remaining lamp sockets 12*a*–12*n* contain respective miniaturized shunt-type incandescent lamps 18*a*–18*n*. As will become apparent, each of lamps 15, 17 and 18*a*–18*n* is connected in a series circuit which is provided with AC power by a conventional plug 20 having a pair of terminals 21 and 22, such power being supplied through a fuse holder 23 containing fuses 25, 26 (see FIG. 2). The flexible insulated wire conductors which interconnect lamp sockets 11, 12*a*–12*n* and 13 are twisted together to provide a string of lights, such string being several feet in length, as noted.

As will become apparent, a first embodiment of the invention makes use of shunt-type incandescent lamps in all of the sockets, while a second embodiment employs fuse lamps in the end sockets 11, 13 and shunt-type lamps in the remaining sockets 12*a*–12*n*.

The string is terminated in a receptacle 27 having a pair of recessed terminals 28, 29 (see FIG. 2) for receiving the terminals of a plug, similar to plug 20 of another string of lights. Accordingly, it will be understood that successive light sets may be strung together end-to-end in tandem fashion.

Each of lamp sockets 12*a*–12*n* is provided with a respective reflector 31*a*–31*n* which is fitted over the respective lamp socket for reflecting and refracting light therefrom. The cross-section of reflector 31*c* is illustrative of the detail. The reflectors are each of a molded synthetic plastic material such as acrylic styrene of a transparent nature having a relatively high index of refraction. Such material is resilient.

More specifically, reflector 31*c* has a collar portion 33*c* encircling the circumference of the exterior surface 35*c* of the socket, such surface being approximately cylindrical. Extending radially outward and upward from collar 33*c* are a plurality of sections or segments 34*c* which are each petal-form. These sections are arcuately spaced around the lamp socket. Thus, light is not only reflected upwardly and outwardly from each of the reflectors but is transmitted through the acrylic material and passes through the spaces between the petal-shaped segments as well. Hence, the light is refracted greatly for causing a sparkling effect.

The end lamp sockets may also have such reflectors, but it is presently preferred to omit them from the end lamp sockets so that in constructing a light string set of the second embodiment wherein fuse lamps are employed in the end sockets, the user will readily be able to identify the fuse lamp sockets which otherwise might be difficult to locate when embedded in the foliage of a tree decorated with the set.

Sockets 12*a*–12*n* constitute a first set of sockets adapted to receive the miniature shunt type incandescent lamps 18*a*–18*n* which are mounted in lamp holders. These lamps each have a filament such as that shown at 37*a* and a filament shunt 39*a* consisting of wire interconnecting the filament leads and permitting flow of current therethrough if the filament should burn out. The end lamps 15 and 17 are each also of a shunted type having a filament such as that designated at 41 having connected thereacross a shunt 42, the shunt again being such as to permit flow of current through the lamp if the filament burns out.

Lamp socket 11, located at one end of the series string, has a terminal 45 connected to one end of series circuit 44. The other end socket 13 has a terminal 47 connected to the other end of series circuit 44. Each of the connections between the terminals 45 and 47 making up series circuit 44, which circuit extends from terminal to terminal of each of sockets 12*a*–12*n*, is constituted by fine gauge insulated wire (e.g. 24 gauge) to provide economy of manufacture and low cost construction. Except for this fine gauge wire interconnecting the several sockets of the string set, the other conductors are of a heavier gauge flexible insulated wire (e.g. 20 gauge).

Such heavier gauge wire is used to provide a connection having portions 49*a* and 49*b* connected through fuse 25 to the first terminal 21 of plug 20. A third connection comprising leads 51*a* and 51*b* connected through fuse 26 connects plug terminal 22 with the second terminal 52 of lamp socket 13. A fourth conductor 54 of this larger gauge wire connects the same terminal 52 of lamp socket 13 with terminal 28 of receptacle 27. Finally, a fifth conductor 55 of such heavier gauge wire interconnects terminal 50 of lamp socket 11 with terminal 29 of receptacle 27. Accordingly, conductors 49*a*, 49*b*, 51*a* and 51*b*, 54 and 55 provide increased current carrying capacity as compared with the conductor arrangement 44 which interconnects the several lamp sockets in series.

As is apparent from FIG. 1, the conductors 49*a*, 49*b* and 51*a*, 51*b* which are connected through fuse holder 23 are twisted together. Similarly, conductors 54 portions of conductor 51*b*, and conductor 55 are twisted together throughout the extent of the lamp socket interconnections of the string set. Finally an end portion of the light set comprising conductors 54 and 55 are twisted together, terminating at receptacle 27.

Figure 2A:
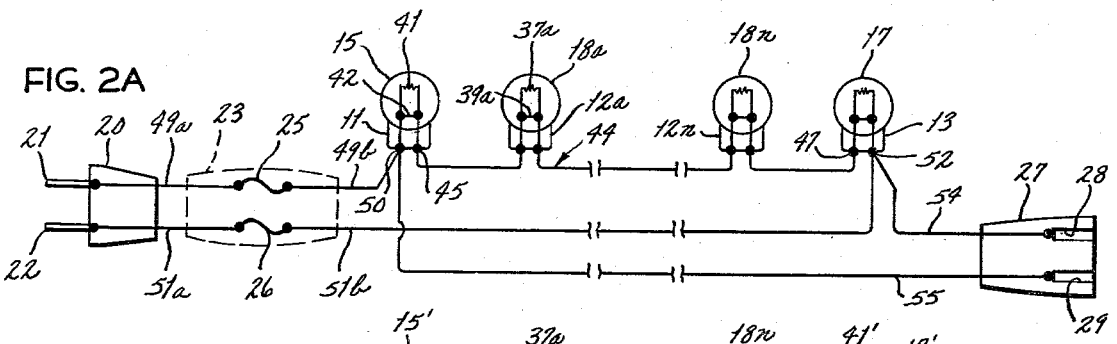
FIG. 2A is an electrical circuit diagram of the light set of FIG. 1.
Figure 2B:
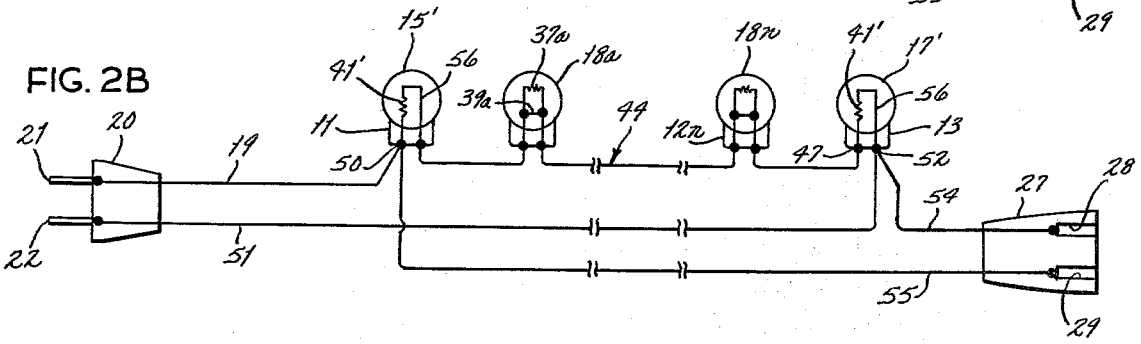
FIG. 2B is an electrical circuit diagram of an alternative embodiment having certain features of the light set of FIG. 1.

FIG. 2B illustrates an alternative embodiment of the invention. This embodiment does not utilize a fuse holder of the type shown in FIG. 2A, but rather employs fuse lamps 15' and 17', said fuse lamps being received in receptacles 11 and 13 at the ends of the series string of interconnected sockets. Said fuse lamps 15' and 17' each has a filament 41' interconnected with the socket by means of a lead-in conductor 56 of "Dumet" metal, such metal having desired thermal expansion characteristics, filament 41' having the characteristic of being fusible and reaching a temperature causing melting thereof in the event of excessive current flow through the filament 41' and conductor 56. Such fuse lamps are constructed in accordance with the teaching of my U.S. Pat. No. 4,030,059, issued June 14, 1977, which is incorporated herein by reference.

Accordingly, there will be seen by reference to FIG. 2*b* that excessive current flowing the series circuit 44 consisting of interconnected lamp sockets in the same wiring configuration shown in FIG. 2A, will cause the conductor portion 56 of the respective fuse lamp 15', 17' to melt and thereby open the circuit for protection thereof. Such excessive current may result, for example, by the shorting together of conductors 44 and 51, as through abrasion thereof.

From the foregoing it will be seen that the circuit configuration of FIG. 2B provides protection against such short circuit conditions or other cause for excessive current flowing in the series circuit 44 in a manner different from FIG. 1 in that a fuse lamp will open-circuit to provide such protection causing extinguishing of all lights in the string, rather than through open circuit operation of one of fuses 25, 26 of the fuse holder. Yet the existence of a short circuit or other circuit overload condition causing such fuse lamp or fuse, as the case may be, to open will result in each case in all of the lights of the string set becoming extinguished. Accordingly, the user will understand that a short circuit condition has existed and may replace a fuse lamp in the case of the circuit of FIG. 2B and attempt use again of the string set to ascertain whether or not a short circuit is still present. If not, continued operation of the string set will be normal in all respects. However, a continuing short circuit will once again cause one of the fuse lamps 15', 17' to open. With either embodiment, the user will thereby be altered to the existence of a short circuit or overload condition and may then investigate the same and correct the condition causing it or take such remedial action as may be necessary to preclude damage and to eliminate any hazardous condition.

FIGS. 3A–3C and 4A–4C compare the configurations of the end lamp sockets with the other sockets and compare the configurations of the preferred fuse lamp with the shunt-type lamps.

Thus, FIG. 3A shows a fuse lamp assembly comprising one of the fuse lamps 15 secured to a lamp holder 57. Similarly, FIG. 4A illustrates one of the shunt-type lamps **18*a* secured to a lamp holder 58 which is of a configuration different from holder 57. Together lamp 15 and holder 57 constitute a lamp assembly which can only be received by one of the end sockets, e.g., socket 11, as shown in cross-section in FIG. 3B. Similarly, the shunt-type lamp 18*a* and its lamp holder 58 together constitute a lamp assembly which can be received only by a lamp socket such as socket 12*a*** shown in cross-section in FIG. 4B.

In accordance with the first preferred embodiment, the lamp holder 57 of the configuration to be received by an end lamp socket 11 or 13 will hold a lamp of the same type as holder 58.

Lamp assemblies as depicted in FIGS. **3*a* and 4*a* are provided by inserting a fuse lamp such as designated at 59 in FIG. 5A or a shunt-type lamp such as that designated at 59' in FIG. 5B into an appropriate lamp holder 57 or 58**.

Referring to FIG. 5A, a fuse lamp of the presently preferred second embodiment incorporates the teachings of the above-identified U.S. Pat. No. 4,030,059 and a specific description is, therefore, not necessary except to indicate generally that such lamp includes a glass envelope 60 from which a pair of electrodes 61, 62 extend from the rounded bottom 63 of the glass envelope. The envelope is sealed in conventional manner as indicated at 64 at the tip thereof.

Similarly, a shunt-type lamp, as depicted in FIG. **5*b*, contains a similar glass envelope 59' having electrodes 61', 62' extending from the bottom 63' thereof. The envelope is similarly sealed as indicated at 64'. The lamp includes a filament 66 and a conventional glass bead 67** for maintaining filament leads in spaced apart relationship within the evacuated glass envelope.

This shunt-type configuration of a miniaturized incandescent lamp utilized in both embodiments is characterized by a shunt 68 constituted by several turns of thin wire such as of aluminum connected across the filament leads just above bead 67. It will be understood that shunt 68 will continue to permit current to flow via electrodes 61', 62' in the event of opening of filament 66, as when the same burns out.

FIG. 6 is illustrative of either type of lamp received within a representative lamp holder 70. Thus, assuming the lamp is of the configuration shown in FIG. 5A, i.e., a fuse lamp 59, the wire leads or electrodes 61, 62 extend downward from the lower envelope portion 63 through a pair of apertures 72, 73 provided in a tip portion 75 of the lamp holder.

The lamp holder also includes side walls 76 for receiving the representative envelope portion 63 of lamp 59, all as illustrated in FIG. 6, the lamp being secured in the lamp holder by distal portions of leads 61 and 62 being bent upward against surfaces at opposite sides of tip portion 75 of the lamp holder. Accordingly, as bent in the form illustrated in FIG. 6, the leads 61, and 62 of the lamp are represented for being connected when the assembly of FIG. 6 is inserted in a recess of an appropriate lamp socket.

The external surface configuration of an end lamp holder, such as that illustrated at 57, is different from the exterior surface configuration of a lamp holder 58, as illustrated in FIG. 4A, for one of the remaining lamps.

As shown in FIG. 3B, an end lamp socket includes a recess 78 for receiving a corresponding side wall 77 of the lamp holder 57. This recess is provided on opposite sides with a pair of grooves 80, 81 which receive corresponding beads 83, 84 or lamp holder 57. Recess 78 also includes flats 79, 79' disposed at opposite sides of the recess, there being corresponding flats such as designated at 77, 77' on the side walls of the lamp holder 57. The tip portion of lamp holder 57 is designated 85 and is of rectangular cross section so as to be received within a recess 86 of lamp socket 11.

The cross section of rectangular socket recess 86 andd corresponding cross section of tip 85 of the lamp holder (FIG. 3C) is smaller in cross section than recess 78 which receives side wall portions 77, 77' of the lamp holder. A pair of terminals 87, 88 are fitted at opposite sides of recess 86 of the lamp socket, such terminals being crimped to corresponding leads 90, 91 to provide the connections for the two terminals of the lamp socket. Such crimps are illustrated at 92, 93. Accordingly, it may be seen that distal portions 95, 96 may contact the surfaces of the respective electrodes 87, 88 of the lamp socket. Such electrode distal portions 95, 96 extend through corresponding apertures 98, 99 in the bottom surface of the lamp holder.

The shunt-type incandescent lamp holder **12*a* includes a corresponding recess 101 having side walls 103 of cylindrical shape for receiving cylindrical form side walls 104 of lamp holder 58. Such lamp holder also includes a rectangular tip portion 106 of the same form as lamp holder 58 which tip portion is received within a deeper recess 107 of lamp socket 12*a* having rectangular cross section. Again, distal portions 109, 110 of the lamp leads extend downward through corresponding apertures 112, 113 in the bottom surface of the lamp holder and are bent upward as shown in FIG. 4A for presentment for contact by electrodes 115, 116 which are crimped to respective leads 118, 119, the latter extending upward into the shunted lamp socket 12*a* and being secured to the electrodes by crimping, as illustrated at 121, 122**.

Because of the flats 79, 79' of each of the end lamp sockets, the lamp holder for each of the remaining lamps, i.e., each being of the configuration shown in FIG. 4A, is precluded from being received within recess 78 of an end lamp socket. Correspondingly, the beads 83, 84 of each of the lamp holders suited for being received by an end lamp socket precludes insertion of a lamp assembly for the end lamps into one of the remaining sockets (i.e., of the configuration shown in FIG. 4B).

Each of the lamp holders and lamp sockets is preferably of a molded synthetic resin material for purposes of economy and ease of manufacture.

FIGS. 7–10 illustrate the details of the fuse holder 23 suited for use in the first embodiment.

Said fuse holder 23 comprises a molded plastic fuse block 121 having a pair of oppositely disposed channels 123, 124 for receiving a pair of cartridge fuses 126 shown in FIG. 9. More specifically, the fuse block 121 in cross-section is of I-beam configuration, the channels 123, 124 being of cross-section corresponding to the cylindrical terminal portions 127, 128 of fuse 126. Electrodes 130, being arcuately formed as indicated at 130 in FIG. 10, are fitted over the terminals 127, 128 of the fuse and crimped to conductors **49*a* and 49*b* and 51*a*, 51*b* as apparent from FIG. 7. Each fuse electrode is crimped to its corresponding conductor, as indicated at 131 in FIG. 10. With a pair of electrodes as shown in FIG. 10 secured to each end of the fuse, the fuse is then pressed into the corresponding one of channels 123, 124 and secured therein by the encircling relationship of the fuse block. A body 132 of molded synthetic resin material is then placed around the fuse block for securing the assembly as depicted in FIG. 7**.

In operation, a new light set of the invention provides not only the advantage of utilizing a fine gauge wire for providing a series circuit and thereby permitting the use of low cost materials, but also provides assurance against the possibility of an overload in such series circuit by virtue of the fuse lamps 15, 17 at the opposite ends of the series connected plurality of miniature incandescent lamps. In addition the configuration permits tandem stringing of plural sets by simply connecting an additional set at the receptacle 27. In the first embodiment, the fuse holder 23 with its fuses 25, 26 provides protection against a short circuit, the possibility of overload from excessive stringing of tandem sets. In the second embodiment, each fuse lamp 15', 17' of a light string set protects that set from current overload conditions.

It will be apparent from the description that the first embodiment makes use of end lamp sockets which are of construction different from the remaining sockets of the series string. While all of the sockets utilized in the first embodiment may be of identical configuration, the construction described and shown herein makes possible for identical wiring of sockets and socket configurations to be employed in both embodiments. Hence, the described embodiments make possible a high degree of manufacturing economy in that either embodiment may be constructed from the same component parts and wiring assemblies. Thus, if it is desired to manufacture light string sets of the second embodiment, the preferred socket configurations described in connection with the first embodiment may be utilized, the only difference being that a fuse lamp holder of the type described in connection with the first embodiment is not employed. Such fuse holder may not be necessary for some intended usages of a light string set, and it may be instead preferred to utilize fuse lamps as shown in connection with said second embodiment. Hence, the constructions shown and described conduce to manufacturing economy and achieve in effect a universal wiring and socket construction.

In view of the foregoing it will be seen that the several objects of the invention and other advantages are achieved by the new constructions wich have been described.

Although the foregoing includes the description of the best mode of the embodiments contemplated carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A light string set comprising a plurality of lamp sockets for receiving incandescent lamps, said sockets being carried by a flexible wiring string extending between a plug at one end of said conductor string and a receptacle at the other end of said conductor string, said receptacle being adapted for receiving a plug of a further light string set for tandem end-to-end connection of plural light string sets, said sockets including a first end socket physically located at one end of said conductor string proximate the plug end of said conductor string and a second end socket physically located at the other end of said conductor string proximate the receptacle end of said conductor string, and a plurality of sockets spaced at intervals between said first and second end sockets, said conductor string comprising first conductor means constituted by insulated wire segments interconnecting all of said sockets in a series circuit, said wire segments each being of wire guage substantially smaller than 20-gauge, said series circuit extending from a terminal of said first end socket to a terminal of said second socket, second conductor means connecting another terminal of said first end socket to a first terminal of said plug, third conductor means connecting another terminal of said second end socket to a second terminal of said plug, fourth conductor means connecting said another terminal of said first end socket to a first terminal of said receptacle, and fifth conductor means connecting said another terminal of said second end socket to a second terminal of said receptacle, and fuse means associated with each of said first and secod end sockets for providing current overload protection, said second, third, fourth and fifth conductor means comprising insulated wire of wire guage substantially larger than said first conductor means.

2. A light string set according to claim 1 and further characterized by said fuse means comprising a pair of fusible elements respectively connecting each end of said series circuit with said first end second terminals of said plug.

3. A light string set according to claim 2 and further characterized by said fusible elements comprising a first fuse connected between the first terminal of said plug and said another terminal of said first end socket and a second fuse connected between the second terminal of said plug and said another terminal of said second end socket.

4. A light string set according to claim 3 and further characterized by a fuse holder containing said first and second fuses, said second and third conductor means extending through said fuse holder.

5. A light string set according to claim 4 and further characterized by said fuse means comprising a pair of cartridge fuses, said fuse holder comprising a fuse block having a pair of oppositely disposed channels for receiving said pair of cartridge fuses, said second and third conductor means each comprising first and second fuse electrodes for contacting the opposite ends of a respective fuse, each of said channels receiving said first and second electrodes.

6. A light string set according to claim 5 and further characterized by said fuse holder comprising a housing for enclosing said fuse block and said fuse electrodes, said second and third conductor means each extending from opposite ends of said housing.

7. A light string set according to claim 2 and further characterized by said fusible elements being constituted by a fuse lamp in each of said end sockets.

8. A light string set according to claim 1 and further comprising miniature incandescent lamps in each of said lamp sockets.

9. A light string set according to claim 8 and further comprising light reflectors encircling at least some of said lamp sockets.

10. A light string set according to claim 9 and further characterized by each of said light reflectors comprising a plurality of sections arcuately spaced around each lamp socket, said sections each extending radially outward and upward from the respective lamp sockets.

11. A light string set according to claim 10 and further characterized by said reflector constituted by transparent molded plastic material having a high refractive index whereby light is not only reflected therefrom but is transmitted therethrough greatly refracted for causing a sparkling effect.

12. A light string set according to claim 8 and further characterized by said lamps each having an envelope having a filament and filament leads extending from said envelope, a lamp holder for holding said envelope with said leads presented for being contacted in a socket, said sockets and lamp holders being cooperatively configured for receiving a respective lamp holder in each socket with terminals of each socket in contact with said leads of a lamp held in the respective lamp holder.

13. A light string set according to claim 12 and further characterized by said first and second end sockets and lamp holders for being received therein being cooperatively configured to provide a first compatible mating relationship and the remaining ones of said sockets and lamp holders for being received therein being cooperatively configured to provide a second compatible mating relationship.

14. A light string set according to claim 12 and further characterized by said first and second compatible mating relationships being mutually exclusive to permit insertion only of one type of lamp in said end sockets and insertion only of another type of lamp in the remaining ones of said sockets.

15. A lamp, lamp holder and lamp socket combination in use in a light string set according to claim 12 wherein each said lamp comprises a glass envelope, said leads being a pair of bendable wire leads extending down from said envelope, each said lamp holder having an elongate body including side walls defining a recess for receiving a lower portion of said envelope, said body including a lower tip portion having apertures for receiving said wire leads with distal portions of said leads extending therethrough, said tip portion including two oppositely disposed surfaces at the sides thereof adjacent said apertures said lead distal portions being bendable upward against said surfaces for securing said lamp in said lamp holder and for presentment of said lead distal portions for being contacted, said lamp socket having a recess for receiving said lamp holder body, said socket recess having electrodes at opposite sides thereof for contacting said lead distal portions.

16. A light string set according to claim 1 and further characterized by said first, third and fifth conductor means being twisted together, said second and third conductor means being twisted together, and said fourth and fifth conductor means being twisted together.

17. A miniature light string set comprising a plurality of lamp sockets for receiving miniature incandescent lamps, a plug for supplying power to said lamps, and a receptacle for connecting another light string set thereto, said lamp sockets being constituted by a first set of sockets adapted to receive miniature shunt-type incandescent lamps of the type having a filament and a filament shunt permitting flow of current through said shunt if said filament burns out, first conductor means for electrically connecting together lamp sockets of said first set in a series circuit string, a second set of sockets comprising first and second fuse lamp sockets each adapted to receive only a fuse-type incandescent lamp, said first fuse lamp socket being at one end of said string proximate said plug and having a terminal connected to one end of said series circuit, said second fuse lamp socket being at the other end of said string proximate said receptacle and having a terminal connected to the other end of said series circuit, second conductor means interconnecting the other terminal of said first fuse lamp socket with a terminal of said plug, third conductor means interconnecting another terminal of said plug with another terminal of said second fuse lamp socket, fourth conductor means interconnecting said another terminal of said first fuse lamp socket with a terminal of said receptacle, and fifth conductor means interconnecting said another terminal of said second fuse lamp socket with another terminal of said receptacle, said first conductor means constituting wire segments each of wire guage substantially smaller than 20-guage, said second, third, fourth and fifth conductor means each comprising insulated wire of wire guage substantially larger than said first conductor means, said fuse lamps being adapted to become open-circuited in the event of excessive current in said series circuit.

18. A light string set comprising a plurality of lamp sockets for receiving incandescent lamps, said sockets being carried by a flexible conductor string extending between a plug at one end of said conductor string and a receptacle at the other end of said conductor string, said receptacle being adapted for receiving a plug of a further light string set for tandem end-to-end connection of plural light string sets, said sockets including a first end socket proximate the plug end of said conductor string and a second end socket proximate the receptacle end of said conductor string, and a plurality of sockets spaced at intervals between and connected in a series circuit with said first and second end sockets, said conductor string comprising conductor means for interconnecting said sockets with said plug and said receptacle, and fuse means comprising a fuse holder in line with said conductor means and containing a first cartridge fuse interconnected by said conductor means with said first end socket and a second cartridge fuse interconnected by said conductor means with said second end socket, said fuse means providing current overload protection for both said wiring string and said receptacle, said fuse holder comprising a fuse block having a pair of oppositely disposed channels for receiving said pair of cartridge fuses, and first and second fuse electrodes for contacting the opposite ends of a respective fuse, each of said channels receiving said first and second electrodes, said fuse block being of unitary molded plastic character and having a cross-section of I-beam configuration, said fuses each having cylindrical terminal portions, said fuse electrodes being arcuately formed for fitting on said terminal portions, said channels being of cross-section corresponding to said terminal portions for press-fit retention of said fuses with fuse electrodes thereon in said channels.

19. A light string set according to claim 18 and further characterized by said fuse holder comprising a housing for enclosing said fuse block and said fuse electrodes, said conductor means including conductors extending from opposite ends of said housing.

* * * * *

UNITED STATES PATENT OFFICE

CERTIFICATE OF CORRECTION

Patent No. 4,223,248 Dated September 16, 1980

Inventor(s) George K. K. Tong

It is certified that error appears in the above-identified patent and that said Letters Patent are hereby corrected as shown below:

Claim 1, Column 8, Line 54 "secod" should be ---second---.

Claim 2, Column 8, Line 62 "end" should be ---and---.

Claim 15, Column 9, Line 65, delete "in" (first occurrence) and insert ---for---.

Signed and Sealed this

*Sixteenth* Day of *December 1980*

[SEAL]

*Attest:*

SIDNEY A. DIAMOND

*Attesting Officer*

*Commissioner of Patents and Trademarks*